US011022278B2

(12) United States Patent
Davis et al.

(10) Patent No.: US 11,022,278 B2
(45) Date of Patent: Jun. 1, 2021

(54) LINEAR STRIP RETROFIT KIT

(71) Applicant: Hubbell Incorporated, Shelton, CT (US)

(72) Inventors: Michael Davis, Greenville, SC (US); Dhavalkumar Patel, Greer, SC (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/820,064

(22) Filed: Mar. 16, 2020

(65) Prior Publication Data

US 2020/0217485 A1 Jul. 9, 2020

Related U.S. Application Data

(63) Continuation of application No. 16/046,459, filed on Jul. 26, 2018, now Pat. No. 10,591,139.

(Continued)

(51) Int. Cl.

| | |
|---|---|
| ***F21K 9/27*** | (2016.01) |
| ***F21V 17/00*** | (2006.01) |
| ***F21K 9/66*** | (2016.01) |
| ***F21K 9/278*** | (2016.01) |
| ***F21K 9/275*** | (2016.01) |
| ***F21K 9/272*** | (2016.01) |
| ***F21V 17/16*** | (2006.01) |
| ***F21V 5/02*** | (2006.01) |
| ***F21V 23/04*** | (2006.01) |

(Continued)

(52) U.S. Cl.

CPC ..... *F21V 17/002* (2013.01); *F21K 9/272* (2016.08); *F21K 9/275* (2016.08); *F21K 9/278* (2016.08); *F21K 9/66* (2016.08); *F21V 5/02* (2013.01); *F21V 17/164* (2013.01); *F21V 23/0471* (2013.01); *F21V 15/015* (2013.01); *F21Y 2103/10* (2016.08)

(58) Field of Classification Search

CPC ..... F21V 17/002; F21V 5/02; F21V 17/164; F21V 23/0471; F21V 15/015; F21V 17/16; F21V 5/04; F21K 9/272; F21K 9/66; F21K 9/275; F21K 9/278; F21Y 2103/10

See application file for complete search history.

(56) References Cited

U.S. PATENT DOCUMENTS 5,584,547 A * 12/1996 Trulaske, Sr. ..... 362/223
5,806,967 A 9/1998 Soorus et al.

(Continued)

FOREIGN PATENT DOCUMENTS

GB 2338545 12/1999

OTHER PUBLICATIONS

PCT/US2018/043891 International Search Report and Written Opinion dated Oct. 30, 2018.

*Primary Examiner* — Y M. Quach Lee
(74) *Attorney, Agent, or Firm* — Michael Best & Friedrich, LLP

(57) ABSTRACT

A light fixture includes a housing, a recessed channel, a light-emitting element, and a lens positioned over the light-emitting element. The housing includes a mounting surface. The recessed channel includes a bottom and a pair of side walls extending along the length of the mounting surface. The light-emitting element is coupled to the bottom of the recessed channel. The lens is positioned over the light-emitting element and removably retained between the pair of side walls.

19 Claims, 6 Drawing Sheets

Related U.S. Application Data

(60) Provisional application No. 62/537,251, filed on Jul. 26, 2017.

(51) Int. Cl.
*F21Y 103/10* (2016.01)
*F21V 15/015* (2006.01)

(56) References Cited

U.S. PATENT DOCUMENTS

| | | | | |
|---|---|---|---|---|
| 7,374,143 | B1 | 5/2008 | Wittke | |
| 9,133,993 | B2 | 9/2015 | Devorris | |
| 2004/0201996 | A1 | 10/2004 | Weber | |
| 2005/0219854 | A1 | 10/2005 | Grady | |
| 2011/0286207 | A1* | 11/2011 | Chan | 362/217.1 |
| 2017/0009946 | A1 | 1/2017 | Jimbo | |
| 2017/0051881 | A1* | 2/2017 | Chamberlain | 362/294 |
| 2017/0309987 | A1 | 10/2017 | Setomoto | |
| 2018/0320885 | A1 | 11/2018 | Musser | |

* cited by examiner

LINEAR STRIP RETROFIT KIT

CROSS-REFERENCE TO RELATED APPLICATIONS

This application is a continuation of co-pending U.S. Non-Provisional application Ser. No. 16/046,459, filed Jul. 26, 2018, which is incorporated herein by reference in its entirety and which claims the benefit of U.S. Provisional Application No. 62/537,251, filed Jul. 26, 2017.

BACKGROUND

The present disclosure relates to the field of luminaires, and particularly to luminaire housings and lenses.

SUMMARY

In one aspect, a light fixture includes a housing, a recessed channel, a light-emitting element, and a lens positioned over the light-emitting element. The housing includes a mounting surface. The recessed channel includes a bottom and a pair of side walls extending along the length of the mounting surface. The light-emitting element is coupled to the bottom of the recessed channel. The lens is positioned over the light-emitting element and removably retained between the pair of side walls.

In another aspect, a light fixture includes a housing, a recessed channel, a light-emitting element, and a lens extending over the light-emitting element. The housing includes a first end, a second end, and a longitudinal axis extending therebetween. The housing includes a mounting surface positioned between the first and second end. The mounting surface includes the recessed channel extending from the first end to the second end along the longitudinal axis. The recessed channel includes a first side wall, a second sidewall, and a bottom disposed therebetween. The lens includes a pair of side portions and an apex portion therebetween, and the pair of side portions is received between the first side wall and the second side wall to removably retain the lens.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. A device consistent with the disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

Figure 1:
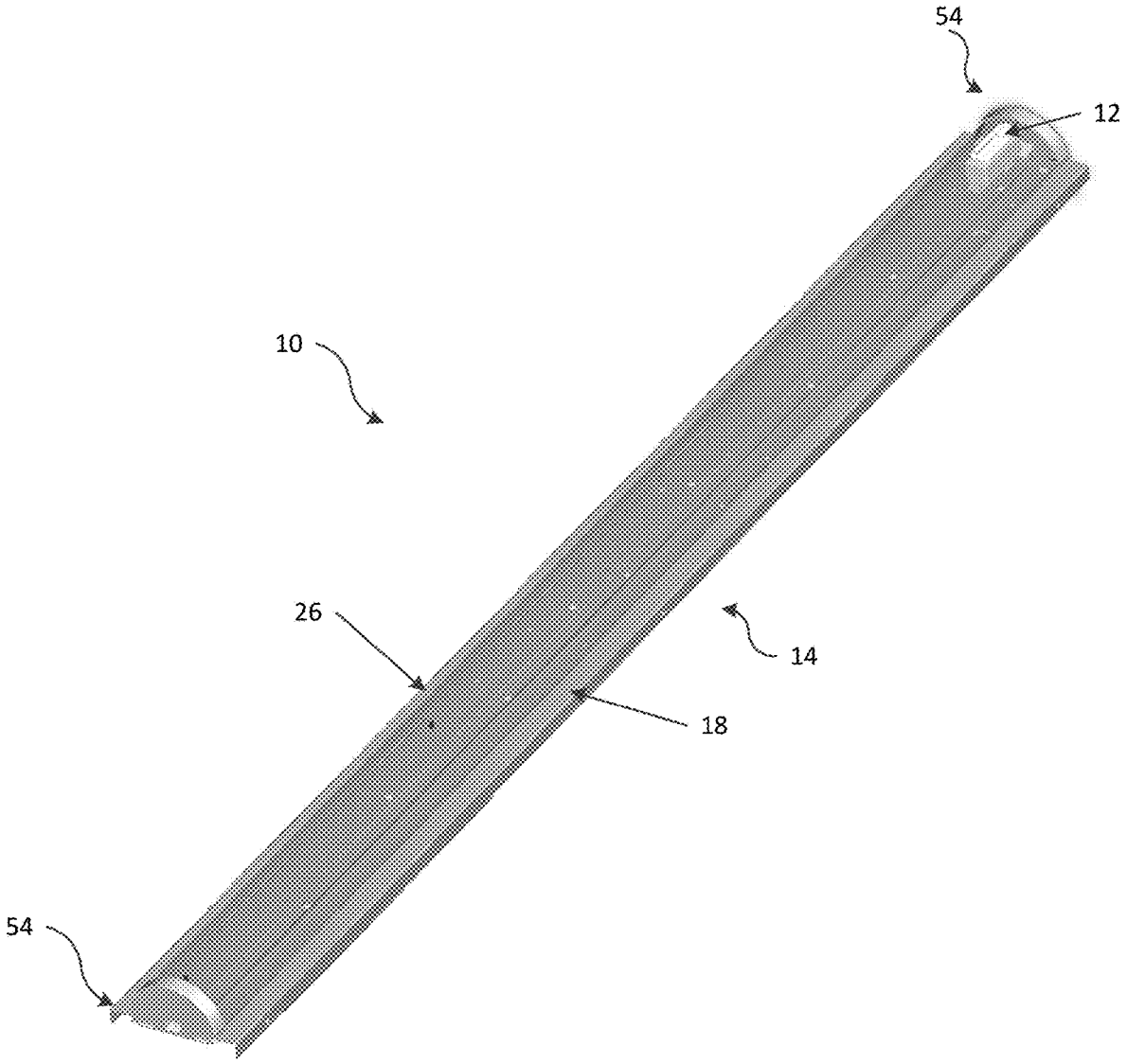
FIG. 1 is a perspective view of a luminaire.
Figure 2:
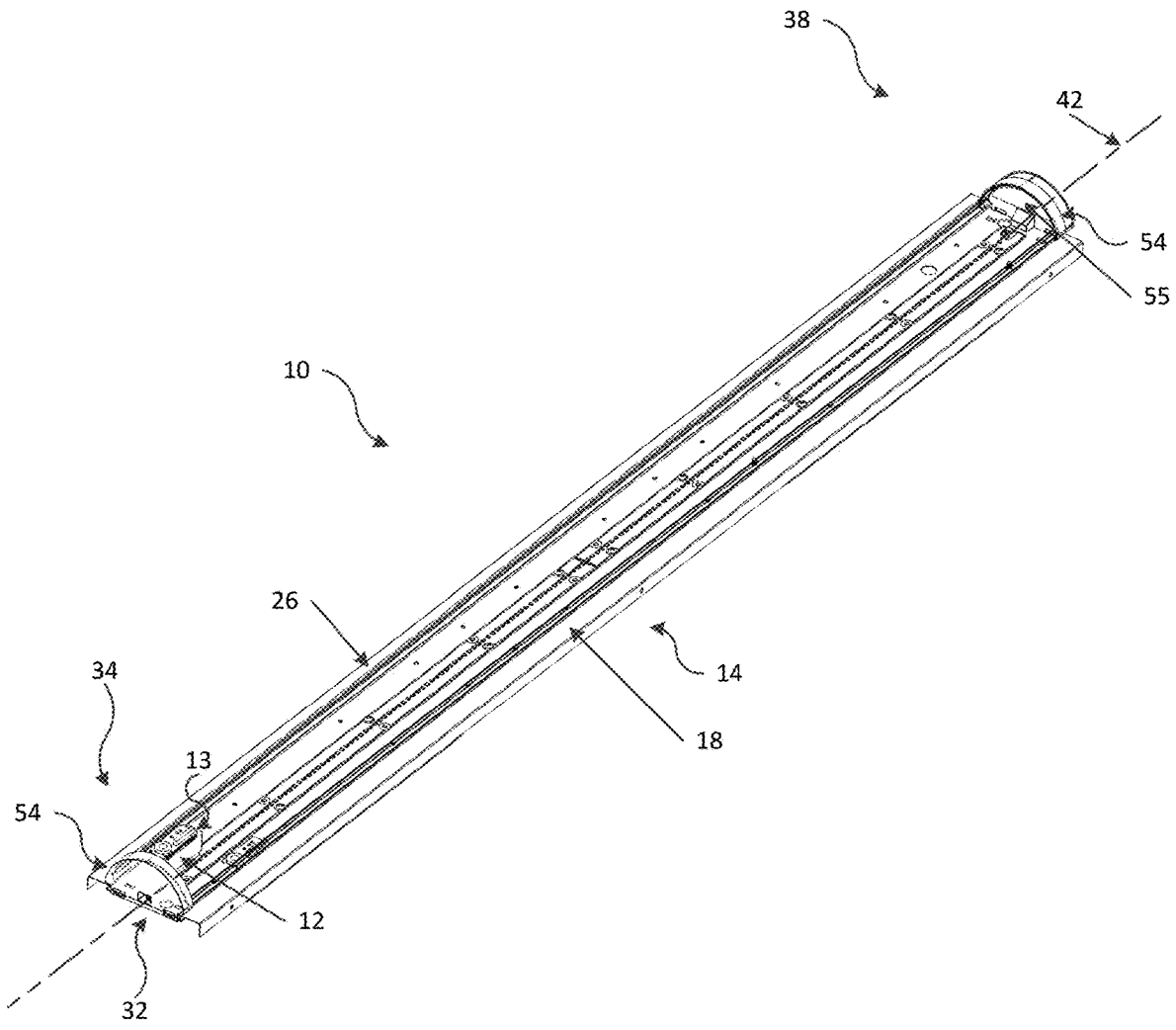
FIG. 2 is a perspective view of the luminaire of FIG. 1.
Figure 3:
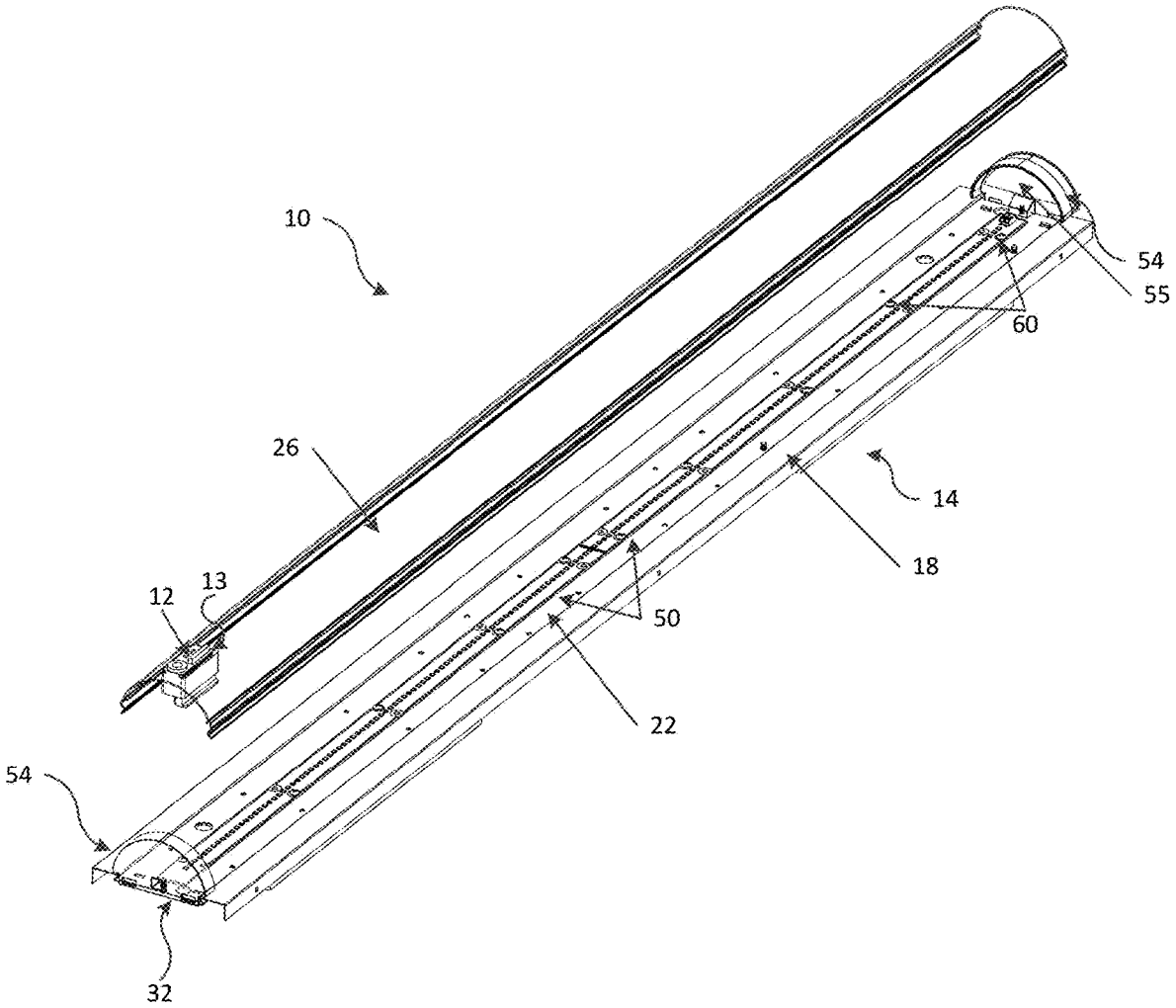
FIG. 3 is a perspective view of the luminaire in FIG. 1 with the lens removed.
Figure 4:
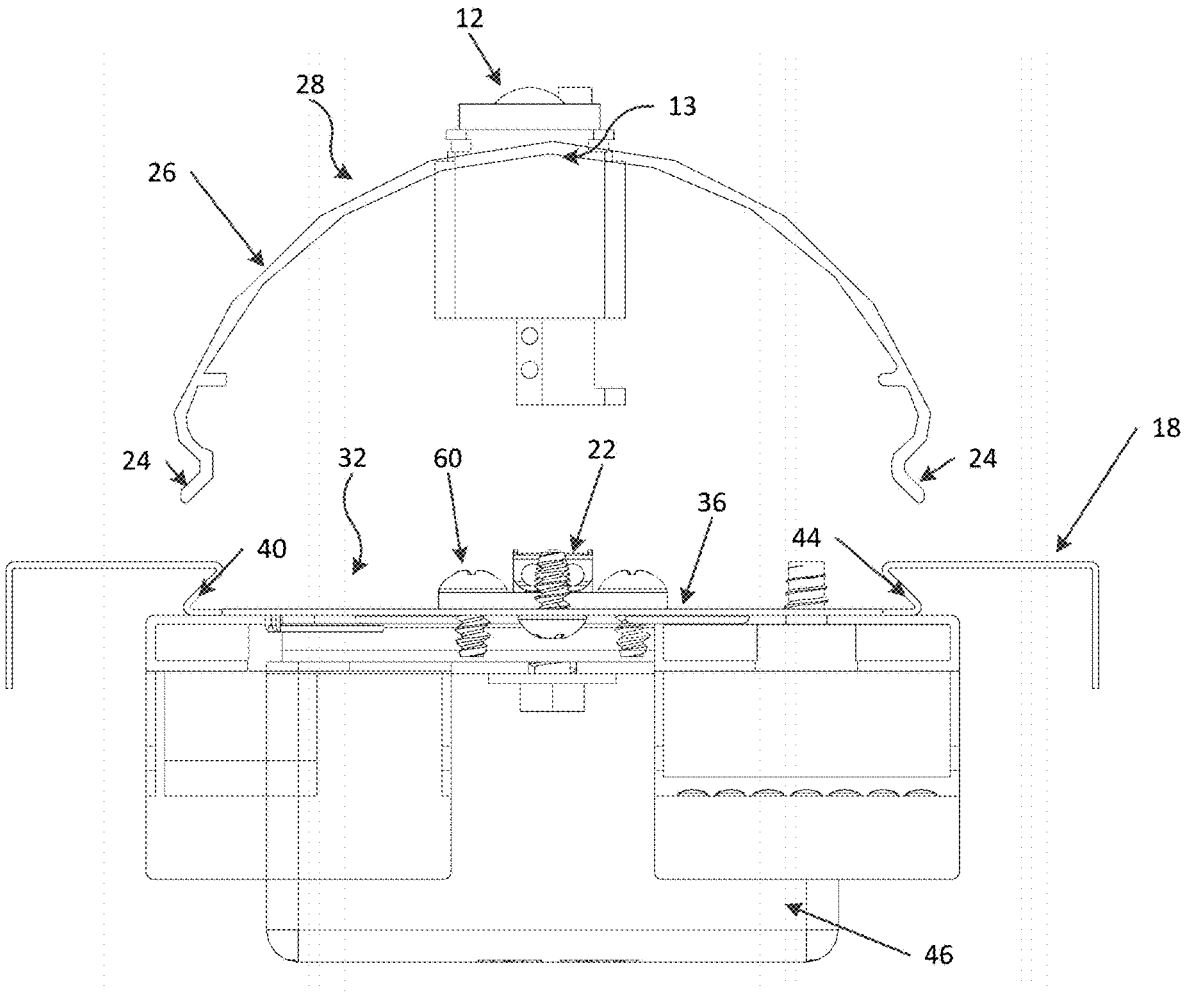
FIG. 4 is an end view of the luminaire in FIG. 1 with the lens removed.
Figure 5:
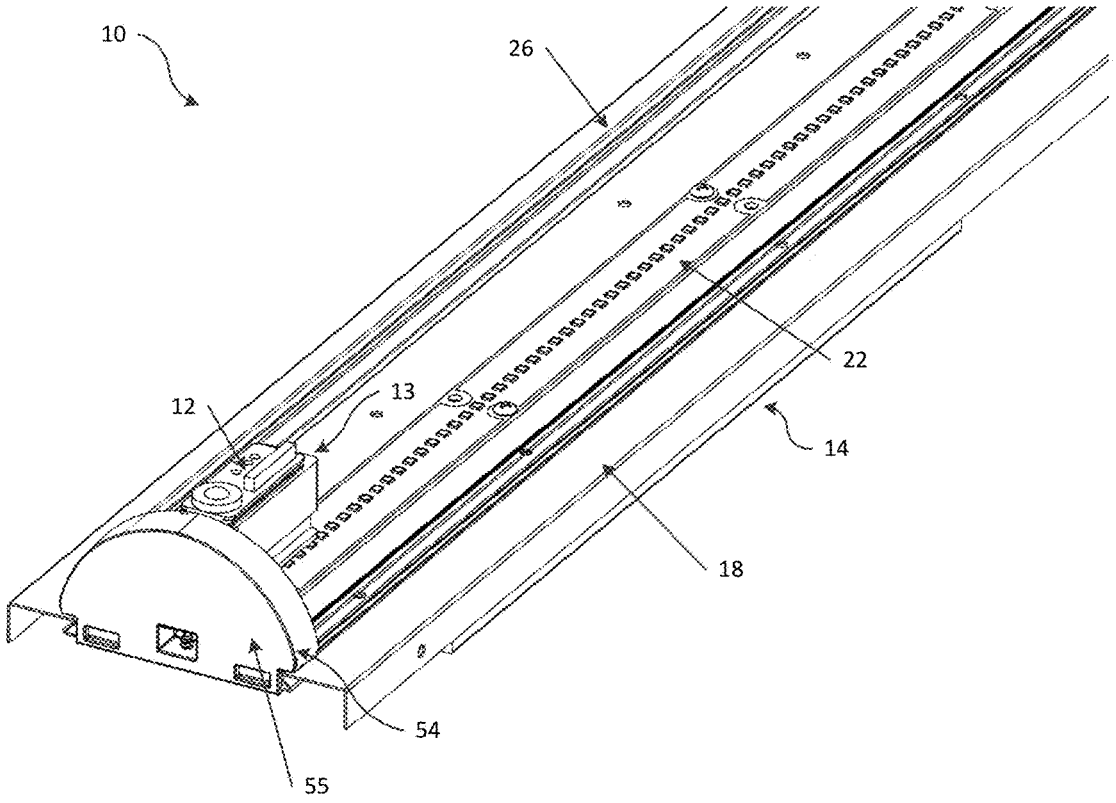
FIG. 5 is an enlarged perspective view of the luminaire in FIG. 1.
Figure 6:
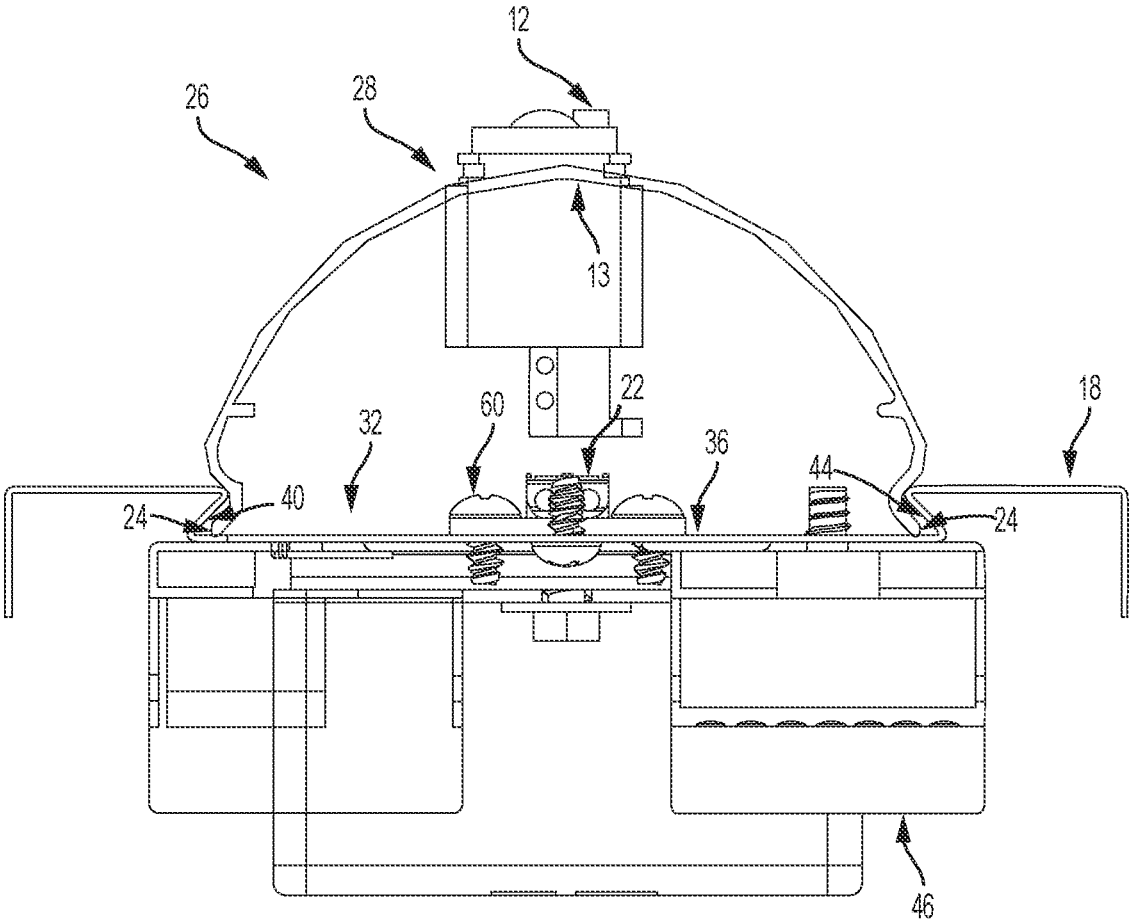
FIG. 6 is an end view of the luminaire in FIG. 1 with the lens retained.

FIGS. 1-6 illustrate a light fixture or luminaire 10. In one embodiment, the luminaire 10 is used in a commercial or industrial environment. The luminaire 10 may be recessed or surface mounted and is electrically connected to a power source (not shown), such as a utility supply of electricity, a battery, a solar cell, a fuel cell, an alternator, a generator, etc. The lighting fixture 10 may include a transformer (not shown), such as a step-down transformer and/or an electronic driver. The luminaire 10 includes a housing 14 defining a mounting surface 18, a light-emitting element 22 (FIG. 3) coupled to the mounting surface 18, and a lens 26. In some embodiments, a lens may include one or more diffusers. As shown in FIG. 2, the housing 14 includes a first end 34 and a second end 38 and defines a longitudinal axis 42 extending between the first end 34 and the second end 38. The housing 14 may be formed from a sheet of metallic material. As shown in FIGS. 4 and 6, the housing 14 may include a driver or controller enclosure 46 containing controller hardware.

Mounting surface 18 is a generally planar, elongated, and extends generally parallel to longitudinal axis 42. A recessed channel 32 is centrally located in mounting surface 18. Recessed channel 32 includes a channel bottom 36, a first side wall 40, and a second side wall 44. The bottom 36 is generally planar, elongated, and extends generally parallel to longitudinal axis 42. In some embodiments, the channel 32 extends along the entire length of housing 14. The channel bottom 36 provides support for light-emitting element 22. For example, the light source is coupled to the channel bottom 36 by way of fasteners 60, such as screws, or by snap fits, adhesive, bonding, welding, or any other suitable coupling. The channel bottom 36 may also act as a heat sink for the light-emitting element 22.

As shown in FIG. 3 the light-emitting element 22 may include multiple light-emitting diode boards 50. Each LED board 50 includes multiple LEDs supported on an elongated circuit board (e.g., a printed circuit board or PCB). The circuit board is secured to the support surface 18 (FIG. 3). The LEDs may be arranged in a linear manner along the length of the circuit board, and the LED board 50 may be oriented parallel to the longitudinal axis 42 (FIG. 2) of the housing 14. In the illustrated embodiment, the light-emitting element 22 includes two LED boards 50 arranged in a linear manner along the length of the housing 14; in other embodiments, the light assembly 22 may include fewer or more light boards 50. In other embodiments, two or more LED boards 50 may be arranged adjacent along the longitudinal axis 42.

As shown in FIG. 4, a lens 26 covers the light-emitting element 22 and is retained in the recessed channel 32. The lens 26 has a pair of side portions 24 and an apex portion 28 between the pair of side portions 24, the side portions 24 configured to be removably retained within side walls 40, 44 of the recessed channel 32 and prevent substantial movement in a direction perpendicular to the longitudinal axis 42.

Side walls 40, 44 may extend toward each other at an acute angle from bottom 36 of recessed channel 32. Side portions 24 of lens 26 may extend away from each other at an angle substantially similar to the angle of side walls 40, 44. The spacing between side portions 24 may be selected such that lens 26 is elastically deformed when retained within side walls 40, 44 and frictionally interfaces with side walls 40, 44 of recessed channel 32, substantially preventing translation of lens 26 in recessed channel 32 in a direction parallel to longitudinal axis 42. A lens 26 may extend along the entire length of housing 14. In this embodiment, lenses 26 of a plurality of linearly adjacent luminaires 10 would form a continuous light seal.

Additionally, a luminaire 10 may include one or more end caps adjacent 54 to lens 26. An end cap 54 includes a pair of side portions and an apex portion between the pair of side portions, the side portions configured to be retained within the side walls of recessed channel 32. The side portions and apex portion of the end cap may be dimensioned similarly to side portions 24 and apex portion 28 of lens 26. Alternatively, side portions and apex portion of end cap may be dimensioned such that end cap overlaps side portions 24 and apex portion 28 of lens 26. An end cap may further have an opaque face portion 55 configured to prevent light from passing through an end of lens 26. End cap 54 may be configured to be retained in two recessed channels 32 of adjacent fixtures 10 for additional benefits such as, for example, providing additional alignment between fixtures.

A luminaire 10 may include one or more sensors 12, such as a motion sensor, an occupancy sensor, a photosensor, etc. Sensor 12 may be configured for wired or wireless networking with one or more of luminaire 10, a second luminaire substantially similar to luminaire 10, or a sensor of the second luminaire substantially similar to sensor 12. Sensor 12 is affixed in an aperture 13 of lens 26, such as, for example, a snap fitting. In a preferred embodiment, aperture 13 is configured such that sensor 12 is oriented perpendicular to the plane of the mounting surface 18. However, other configurations are possible, depending on the intended luminaire installation orientation and location. Alternatively, sensor 12 may be affixed in a mesial fitting (not shown), wherein a custom interior of the mesial fitting is configured to securably retain sensor 12 and an exterior of the mesial fitting is configured to be securable retained in a general purpose aperture 13 of lens 26. Said general purpose aperture 13 may be configured to retain a plurality of different mesial fittings corresponding to different sensors 12.

Although aspects have been described in detail with reference to certain preferred embodiments, variations and modifications exist within the scope and spirit of one or more independent aspects as described.

What is claimed is:

1. A light fixture comprising:

a housing having a length in a longitudinal direction and formed from a sheet of metallic material;

a recessed channel defined within the housing, the recessed channel itself defining a bottom mounting plate at a bottom of the recessed channel, and further defining a first lens retaining side wall and a second lens retaining side wall, wherein the first lens retaining side wall and the second lens retaining side wall extend along the length of the bottom mounting plate in the longitudinal direction, and wherein the first lens retaining side wall and the second lens retaining side wall each extend at an acute angle from the bottom mounting plate toward each other such that a first underside of the first lens retaining wall and a second underside of the second lens retaining wall both overhang the bottom of the recessed channel;

a lens positioned over the bottom mounting plate, the lens removably retained by a first side portion of the lens mechanically engaging the first underside of the first lens retaining side wall and by a second side portion of the lens mechanically engaging the second underside of the second lens retaining side wall such that the first and second side portions of the lens are closed in and mechanically retained over the bottom of the recessed channel by the first and second undersides of the first and second lens retaining sidewalls; and, a light-emitting element coupled to the bottom mounting plate.

2. The light fixture of claim 1, wherein the light-emitting element is a light emitting diode coupled to a board, and wherein a fastener extends through the board and into the bottom mounting plate.

3. The light fixture of claim 1, wherein the light-emitting element comprises a single board comprising a single row of light emitting diodes coupled thereto.

4. The light fixture of claim 1, wherein the light-emitting element comprises a single board comprising a plurality of rows of light emitting diodes coupled thereto.

5. The light fixture of claim 1, wherein the light-emitting element comprises a plurality of boards each comprising a single row of light emitting diodes coupled to each board, each board spanning only a portion of the longitudinal length of the bottom mounting plate.

6. The light fixture of claim 1 wherein the light-emitting element comprises a plurality of boards each comprising a plurality of rows of light emitting diodes coupled to each board, each board spanning only a portion of the longitudinal length of the bottom mounting plate.

7. The light fixture of claim 1, wherein the lens includes an apex portion there between the first and second side portions, and the pair of side portions extend away from each other at an angle substantially similar to the acute angle of the first and second lens retaining side walls.

8. The light fixture of claim 7, wherein the apex portion is defined by elastic deformation of the lens as a byproduct retention of the lens by the housing.

9. The light fixture of claim 1, wherein the lens frictionally interfaces with the first and second lens retaining sidewalls such that the lens is substantially prevented from movement in a direction perpendicular to a longitudinal axis of the housing.

10. The light fixture of claim 1, wherein the lens is fully retained along the entire length of the housing.

11. The light fixture of claim 10, wherein the lens is retained such that, when a plurality of such light fixtures are positioned linearly adjacent to one another, the lenses form a continuous light seal.

12. The light fixture of claim 1, further comprising a pair of lens end caps, oppositely disposed along the longitudinal axis, adjacent to the lens, the pair of lens caps independently and removably retained in the recessed channel.

13. The light fixture of claim 12, further comprising an end cap including a first side portion, a second side portion, and an apex portion between the first and second side portions, the first and second side portions configured to be retained within the lens retaining side walls of recessed channel.

14. The light fixture of claim 13, wherein the end cap further includes a first overhang coupled to the first side portion and disposed between the first side portion and the apex, the overhang extending in a direction generally perpendicular to the longitudinal direction and parallel to the bottom mounting plate.

15. The light fixture of claim 1, wherein the housing and recessed channel are formed by bending the metallic material.

16. A product comprising:

a removable lens for retention in a light fixture, wherein the lens overlays an endcap of the light fixture and is retained in the light fixture as a byproduct of an elastic deformation of the lens that is applied to the lens during an installation of the lens into the light fixture.

17. The product of claim 16, wherein a light emitting element is housed in the light fixture, and wherein the lens is distinct from the light emitting element.

18. The product of claim 16, wherein the lens is constructed and arranged to be retained in the light fixture as a byproduct of being mechanically constrained by a first lens retaining sidewall and a second lens retaining sidewall that are defined by a recessed channel within a housing of the light fixture.

19. The product of claim 18, wherein the lens is further constructed and arranged to be retained within the light fixture via the first lens retaining wall and the second lens retaining wall mechanically constraining the lens such that the elastic deformation of the lens that was applied to the lens during the installation of the lens into the light fixture is maintained, and a frictional engagement between the lens and the first lens retaining sidewall and second lens retaining side wall is induced.

* * * * *